US005282634A

United States Patent [19]

Chamberland

[11] Patent Number: 5,282,634

[45] Date of Patent: Feb. 1, 1994

[54] PINCERS FOR THROWING AND CATCHING A FLYING DISC

[76] Inventor: Marc Chamberland, R.R. #6, Cobourg, Ontario, Canada, K9A 4J9

[21] Appl. No.: 36,365

[22] Filed: Mar. 24, 1993

[30] Foreign Application Priority Data

Mar. 30, 1992 [CA] Canada ..... 2,064,398-6

[51] Int. Cl.[5] ..... A63B 65/00

[52] U.S. Cl. ..... 273/318; 81/418; 124/5; 124/42

[58] Field of Search ..... 273/317, 318, 424; 124/5, 42; 294/3, 8.5, 11; 81/381, 420

[56] References Cited

U.S. PATENT DOCUMENTS

| | | | |
|---|---|---|---|
| 689,731 | 12/1901 | Lammers | 294/8.5 |
| 1,484,100 | 2/1924 | Wertz | 294/11 |
| 1,508,967 | 9/1924 | Fernandez | 294/3 |
| 1,607,874 | 11/1926 | Darton | 124/5 |
| 2,082,699 | 6/1937 | Keppinger | 294/3 |
| 2,488,484 | 11/1949 | Vander Clute | 81/420 X |
| 2,535,215 | 12/1950 | Klenk | 81/381 X |
| 2,690,339 | 9/1954 | Hall | 124/5 X |
| 2,887,110 | 5/1959 | Roeschmann | 81/300 |
| 3,075,769 | 1/1963 | Cunningham | 273/318 |
| 3,384,411 | 5/1968 | Zlotnicki | 81/381 X |
| 3,901,208 | 8/1975 | LaPorte | 124/5 |
| 4,155,552 | 5/1979 | Jacobo et al. | 124/5 X |
| 4,170,215 | 10/1979 | Kettlestrings | 124/42 X |
| 4,233,952 | 11/1980 | Perkins | 124/5 |
| 4,905,988 | 3/1990 | Mooneyhan | 273/318 X |
| 5,181,500 | 1/1993 | Chamberland | 124/5 |

*Primary Examiner*—William H. Grieb

*Attorney, Agent, or Firm*—Wegner, Cantor, Mueller & Player

[57] ABSTRACT

The pincers have lower and upper jaws which selectively close for engaging and open for disengaging a flying disc such as a FRISBEE. The jaws are interconnected at one end and have at the opposite ends of each, a pad for gripping the cental portion of the disc. A wall of the lower jaw has a depression which opens upwardly toward the inner wall of the upper jaw. The depression is defined at one side by a ramp which extends to the pad attached to the lower jaw. The other side of the depression is defined by a wall which curves to a ridge. A notch is formed on the side of the ridge opposite the depression for receipt of the rim of the disc when it is clamped between its jaws.

12 Claims, 6 Drawing Sheets

PINCERS FOR THROWING AND CATCHING A FLYING DISC

BACKGROUND OF THE INVENTION

This invention relates to a device for catching and throwing a projectile. More particularly the invention relates to pincers for launching a flying disc such as a FRISBEE (a trade mark) in flight and for intercepting and grabbing the disc as it is travelling through the air.

Devices are know for launching projectiles such as FRISBEES in flight. U.S. Pat. No. 4,233,952 to Perkins illustrates one such device. That device includes a yoke for engaging a projectile and an elastic band which serves as a catapult. When the projectile is attached to the yoke and is swung upward, the projectile is driven into the air.

Devices such as that described in the Perkins patent suffer from a number of shortcomings. They can for example only be used for launching projectiles into the air; they cannot be used for catching them when they are in flight. Moreover such devices employ mechanical means, such as a catapult, for accelerating the projectile through the air. Mechanical means give an unfair advantage to the person operating the device over a person who is throwing a projectile by hand. Another shortcoming of such devices is that they are relatively complicated of construction and hence are relatively expensive to make.

SUMMARY OF THE INVENTION

It is an object of this invention to provide a device which is suitable not only for launching a flying disc such as a FRISBEE into the air but also for catching it in flight.

Another object of the invention is to provide a device which employs no mechanical means for accelerating the disc in flight. The physical exertion and skill of the operator of the device alone will determine its speed and trajectory. In that respect the operator will have no undue advantage over a person who throws the disc by hand.

A still further object is to provide a device for improving an operator's grip on a flying disc. By means of the device the operator may with facility and accuracy launch a flying disc into the air and catch it in flight.

These and other objects are accomplished by pincers for throwing and catching a flying disc having a central portion and a rim which is disposed out of the plane of the central portion, the pincers comprising: lower and upper jaws which selectively close for engaging and open for disengaging the disc, the jaws being interconnected at one end and having at the opposite ends of each, a pad for gripping the cental portion of the disc, the jaws further having inner walls which face one another, the inner wall of the lower jaw having a depression which opens upwardly toward the inner wall of the upper jaw, the depression being defined at one side by a ramp which extends to the pad formed on the lower jaw and at the other side by a wall which curves to a ridge, a notch being formed on the side of the ridge opposite the depression for receipt of the rim when the disc is engaged by the pincers.

DESCRIPTION OF THE DRAWINGS

The pincers of the invention are described with reference to the accompanying drawings in which.

Like reference characters refer to like parts throughout the description of the drawings.

DESCRIPTION OF THE PREFERRED EMBODIMENT

Figure 1:
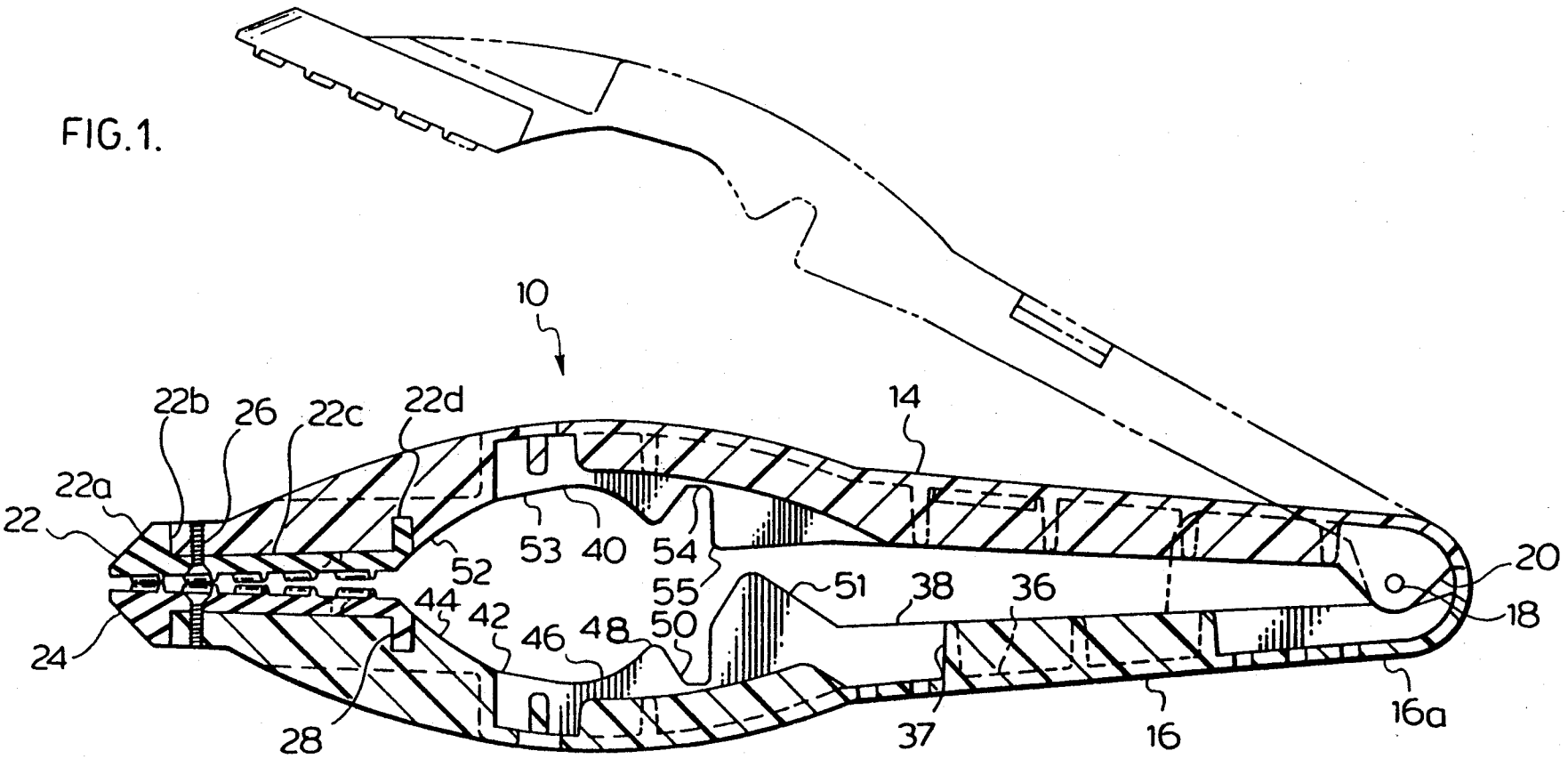
FIG. 1 is an elevation, partly in section, of the pincers in which the upper jaw is shown closed in solid lines and open in broken lines.
Figure 2:
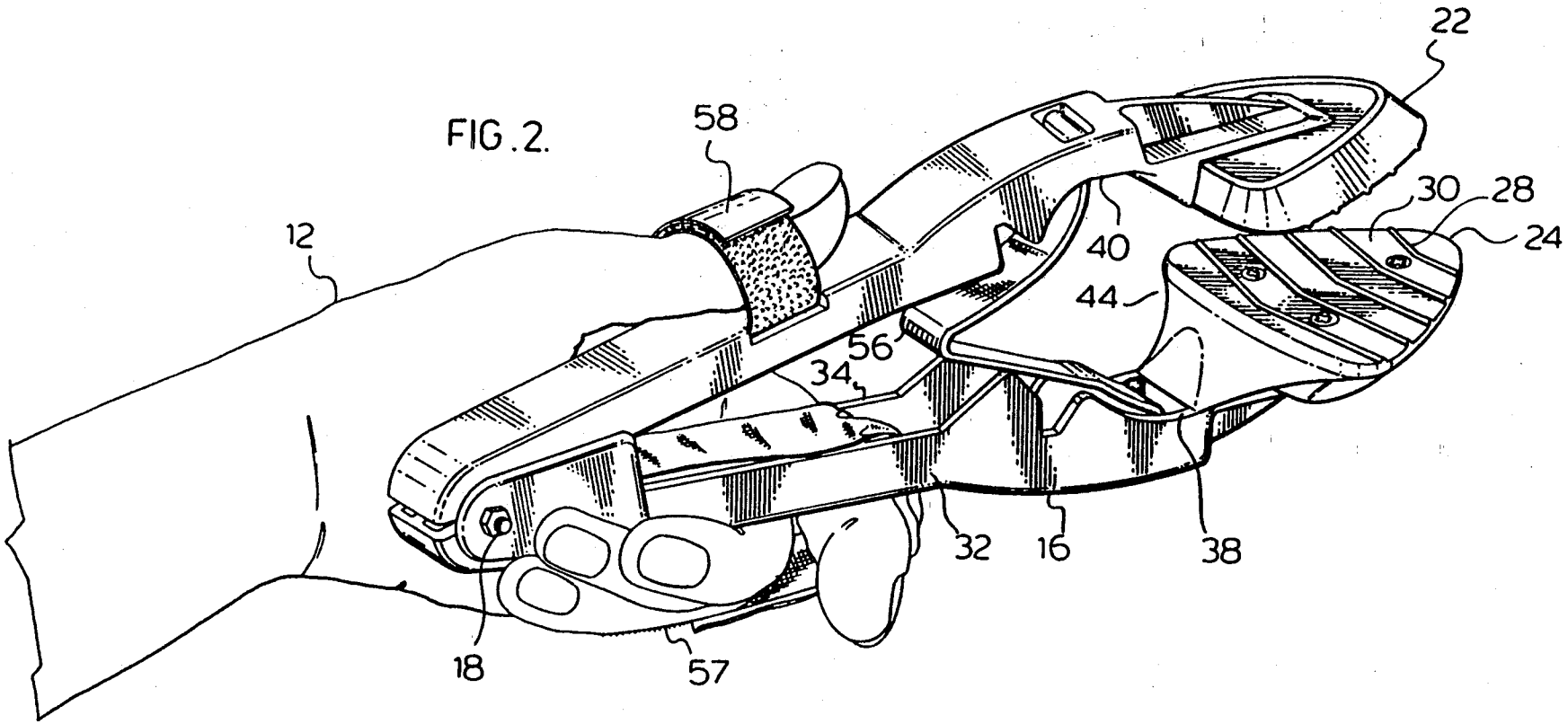
FIG. 2 is a perspective view of the pincers shown being held by an operator.

With reference to FIGS. 1 and 2, the pincers of the invention are indicated generally by the numeral 10 and are shown held in the hand 12 of an operator. The pincers include a pair of upper and lower jaws 14, 16 which are pivotally interconnected by means of a stud 18. The stud passes through a pair of spaced ears 20 formed in the end portion of the upper jaw and through an aperture formed in the end portion **16*a*** of the lower jaw. The latter portion is located between the two ears.

An upper pad 22 is connected to the end of the upper jaw opposite the pivotal interconnection and a like lower pad 24 is connected to the end of the lower jaw. The upper pad has a forward portion **22*a* having rear wall 22*b* which abuts against the forward end of the upper jaw. The pad has an intermediate portion 22*c* which is connected to the jaw by three screws 26 and a rear portion 22*d* which extends upwardly into a recess in the jaw. The pad is thus firmly attached to the jaw to prevent any movement of the pad relative to the jaw. Lower pad 24** has a like construction and it too remains stationary relative to the lower jaw.

As illustrated in FIG. 2, the pads are generally triangular in shape and have ribs 28 which project upwardly from the surfaces 30 which face the disc.

Figure 6:
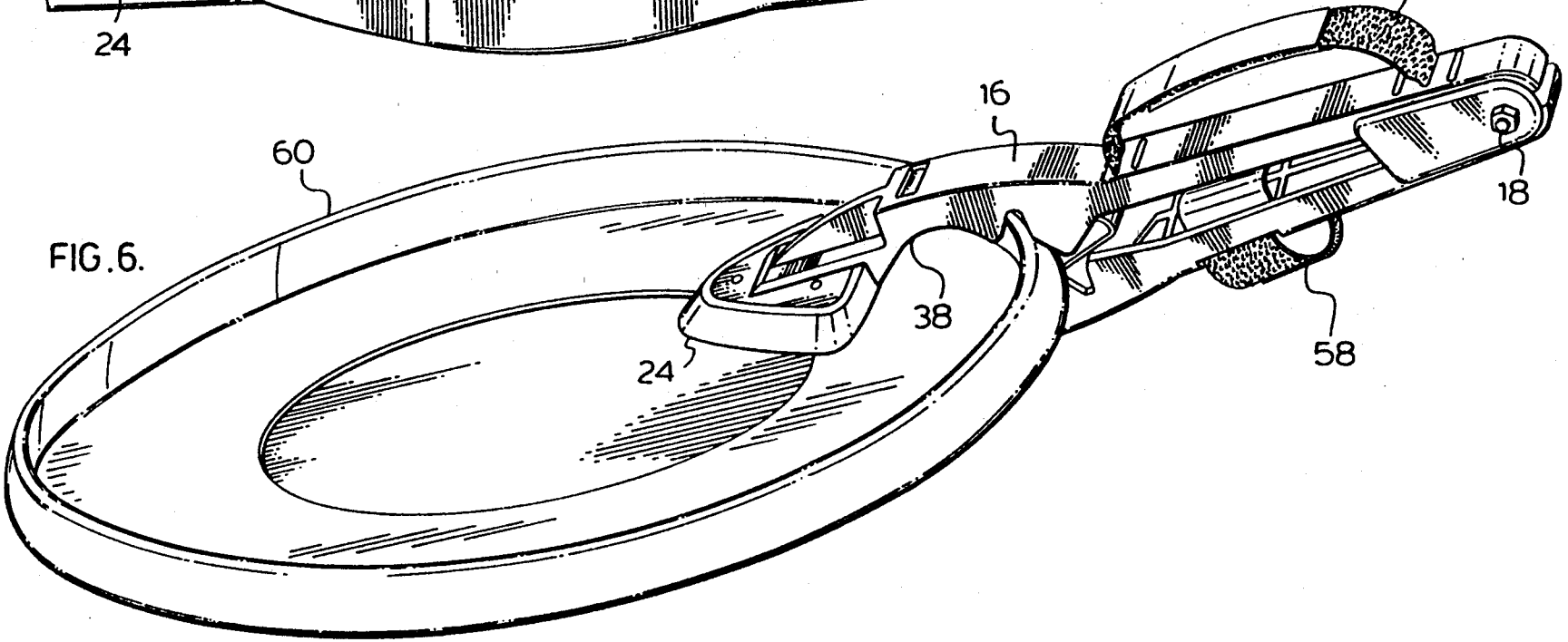
FIG. 6 is a perspective view of the pincers turned upside down showing the underside of a disc clamped between the jaws of the pincers.

The forward portions of each jaw to which the pads are attached are solid. Elsewhere however the jaws are not solid. Rather they have a channel or U shaped cross-section. The lower jaw 16 has two upstanding side walls 32, 34 which are spaced apart from one another. A lower wall or web 36 extends between and interconnects the two side walls along a longitudinally extending lower edge of each. The side walls are reinforced by means of a framework 37 of longitudinal and lateral braces (FIG. 6).

Each side wall 32, 34 has an inner wall 38 along the longitudinally extending upper edge of each. The inner walls face like inner walls 40 on the side walls of the upper jaw. A depression 42 is formed in each inner wall 38 and the depression opens upwardly toward the other inner wall 40. Each depression is bounded at one side by a ramp 44 which extends upwardly and outwardly and terminates at the pad 24. The other side of the depression is bounded by a wall 46 which curves smoothly upwardly and outwardly to a ridge 48. A notch 50 is formed in the inner wall on the opposite side of the ridge and beyond the notch is a protuberance 51.

The inner wall of the upper jaw likewise has a ramp 52, depression 53 and a notch 54 of the same shape as the like named components in the lower wall. Having such a construction allows the pincers to be operated upside down as well as right side up so that the disc can be launched in any position that suits the operator.

A ridge 55 is formed on the inner wall of the upper jaw. When the jaws are closed the space between the ridge and the protuberance is too confined to allow the disc to pass thus the ridge and protuberance co-operate to limit the disc from advancing beyond these parts and striking the operator's hand.

A strip 56 of flexible material (illustrated in FIG. 2 but not in FIG. 1) extends between the two jaws. The ends of the strip are attached to the lower wall or web of each jaw. The strip is narrow enough to fit between the two side walls of each jaw and serves to guide the rim of the flying disc into the notch 50 in the manner described below.

A strap 57 in the shape of a loop is attached to the lower jaw 16 and another loop-shaped strap 58 is attached to the upper jaw. The larger strap 57 accommodates the thrower's fingers and the smaller strap 58 accommodates his thumb. The strap is made of flexible material such polymeric material and its ends are interconnected by suitable means such as dome fasteners or, as illustrated, by VELCRO so that its opening may be adjusted to the size of the thrower's fingers and thumb.

Figure 3:
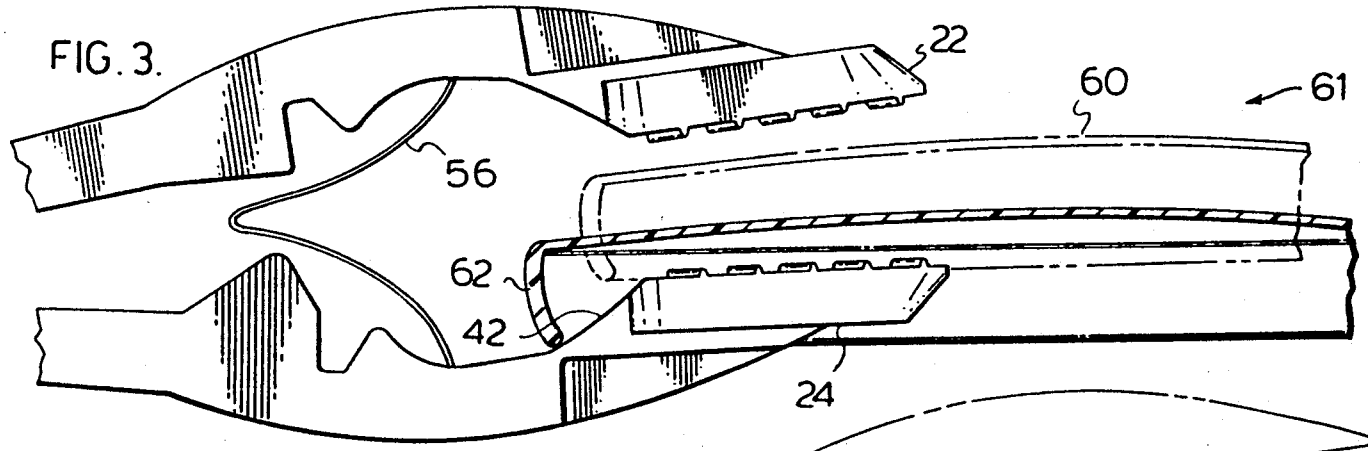
FIG. 3 is an elevation of the pincers shown open to receive a flying disc.
Figure 4:
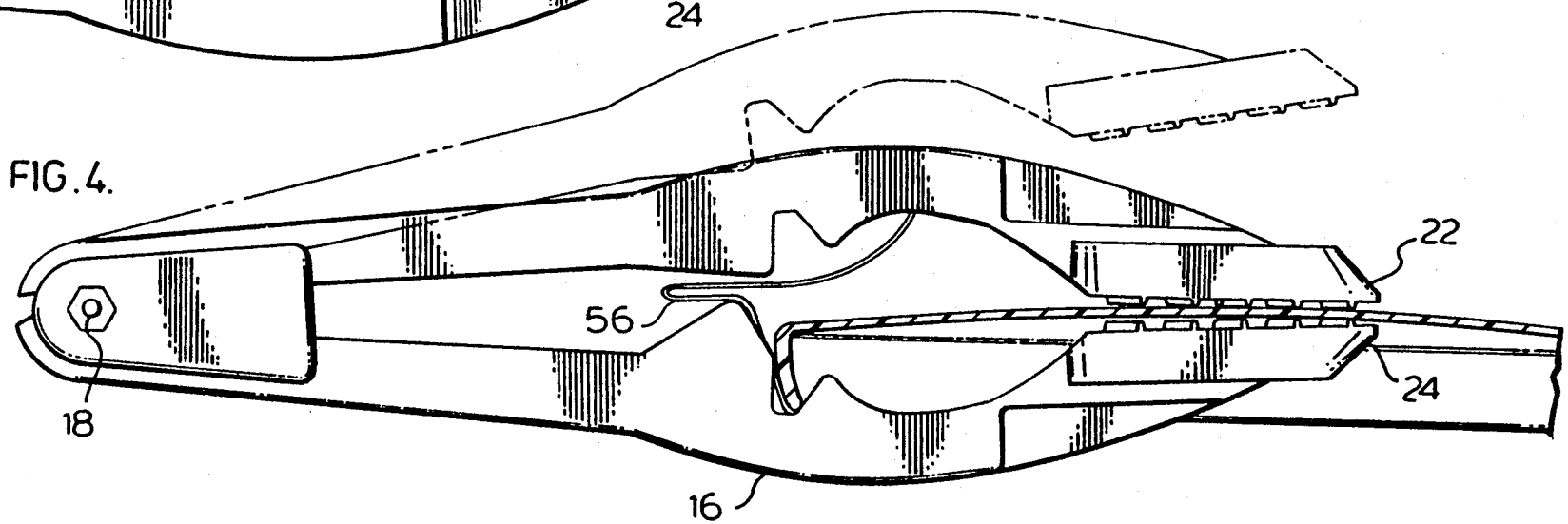
FIG. 4 is another elevation of the pincers shown open in broken lines and closed in solid lines in contact with a disc.
Figure 5:
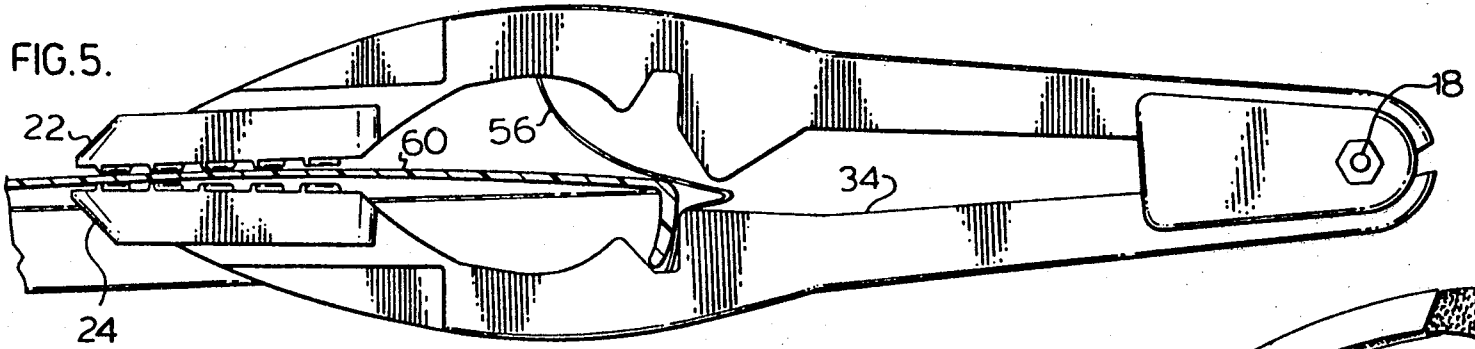
FIG. 5 is another elevation of the pincers showing a disc clamped between its jaws.

FIGS. 3 and 4 show a flying disc 60, travelling in the direction of arrow 61 being caught by the pincers and FIGS. 5 and 6 show the disc after it has been caught. In FIG. 3, the rim 62 of the disc that is shown in broken lines has passed through the space between the two pads 22, 24. The disc shown in solid lines in the same Figure has penetrated further into the space between the two jaws and its rim is in contact with the lower area of the ramp.

FIG. 4 shows the furthermost point of advance of the disc into the space. In that Figure, the rim of the disc is within notch 50. If the jaws are wide open, strip 56 will prevent the disc from advancing beyond the notch. If the jaws are partly or completely closed, the protuberance 51 on the lower jaw and ridge 55 on the upper jaw will prevent the disc from advancing beyond them because there is too little space between them to allow the disc to pass. Thus whether the jaws are wide open, partially closed or completely closed, the disc will not advance beyond the ridge and the protuberance.

Figure 7:
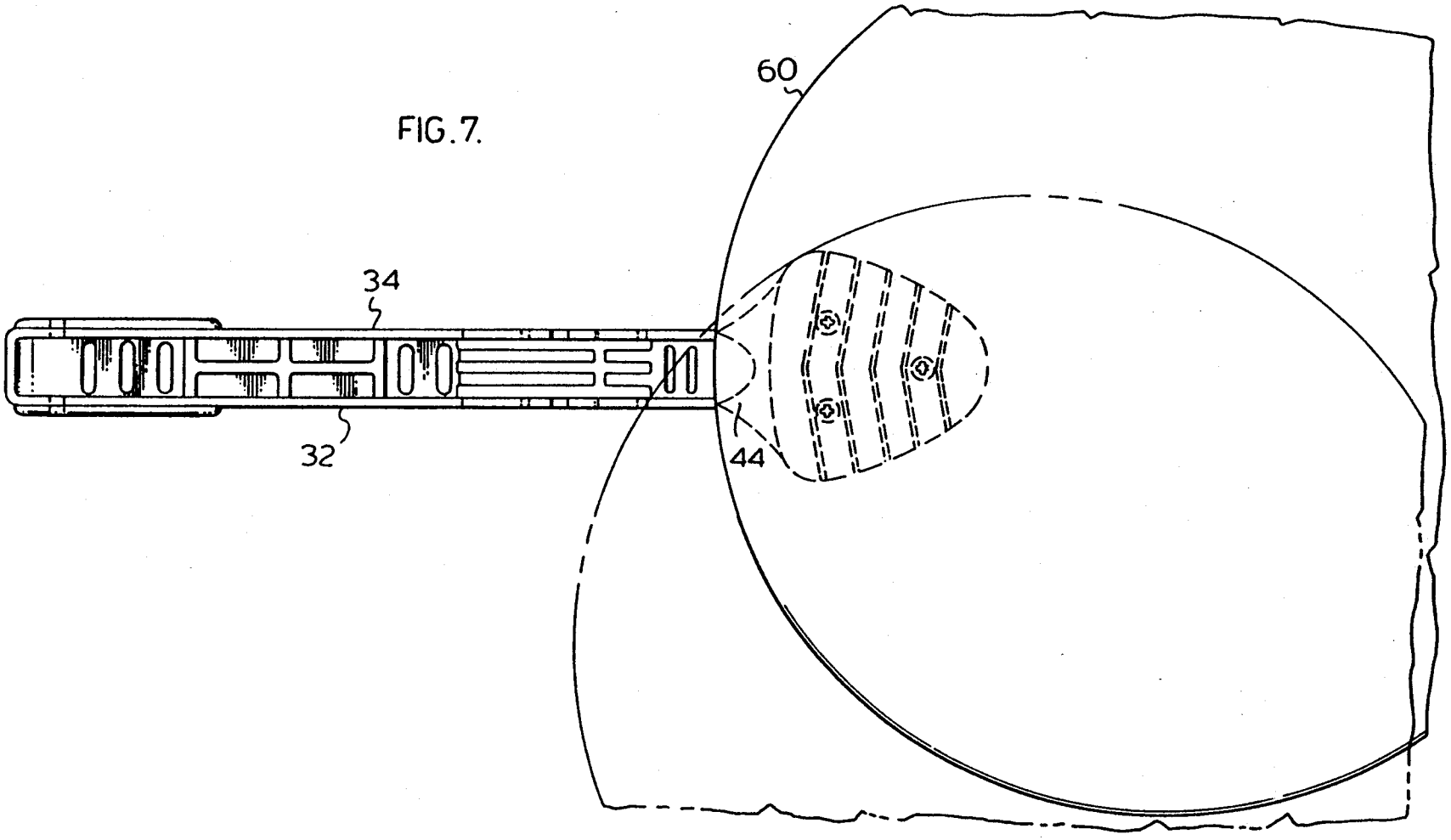
FIG. 7 is an elevation, in enlarged scale, showing a disc in broken lines in position to be launched and the same disc in solid lines at the time of launch.
Figure 8:
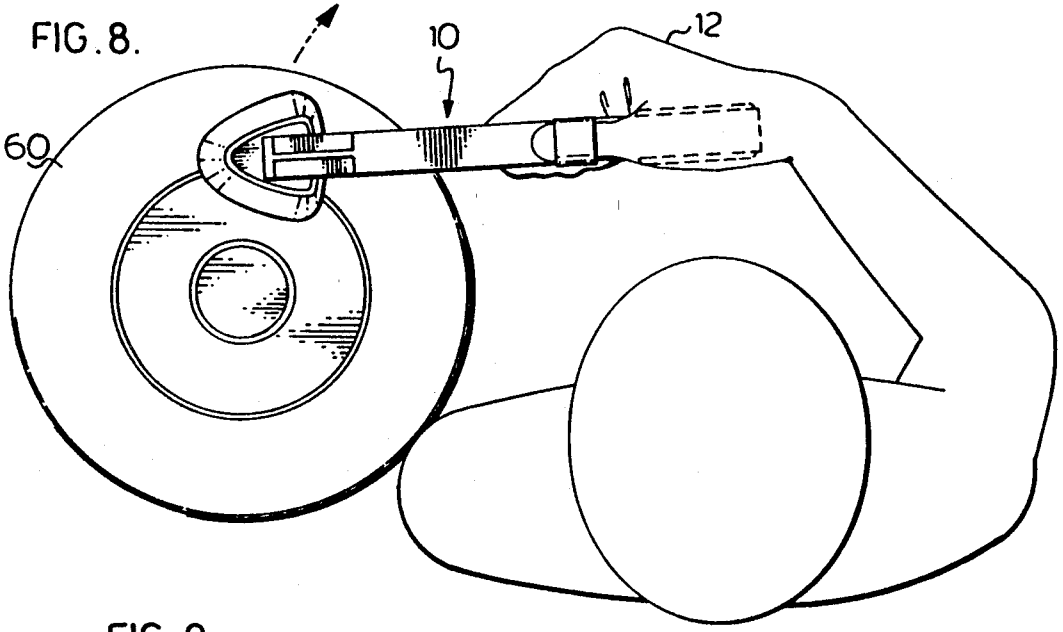
FIGS. 8 and 9 are elevations showing the pincers being used to launch a disc.
Figure 9:
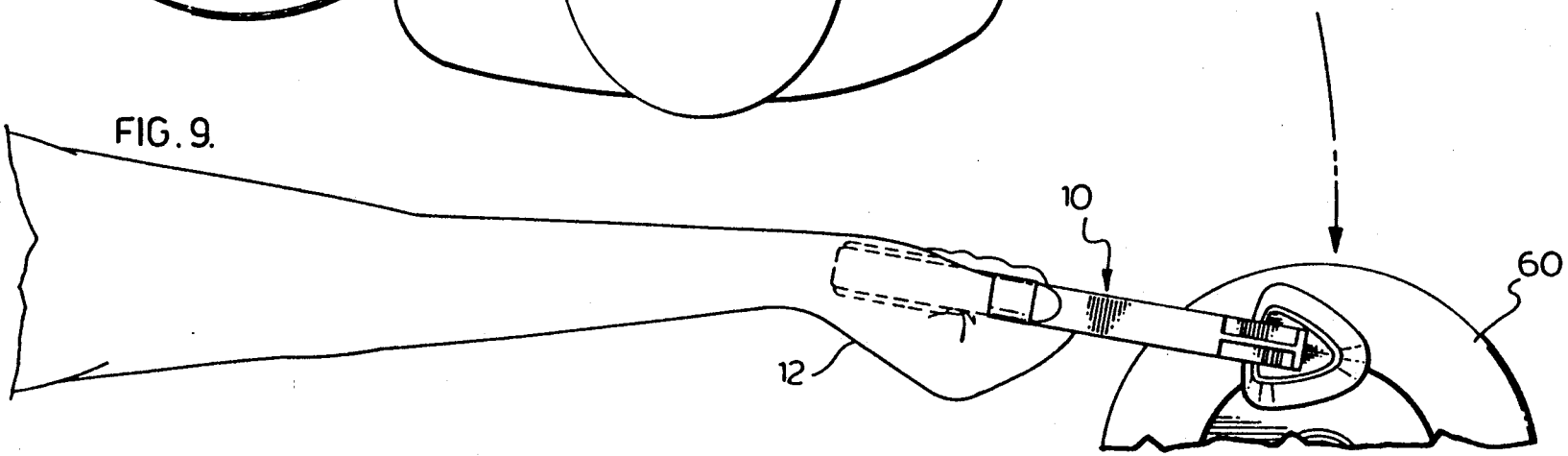

The method of launching the flying disc is illustrated in FIGS. 7 to 9. With reference first to FIG. 7, prior to launching the disc, it is placed between the jaws in the position shown in broken lines where its rim is in the notch in side wall 32 but not in the notch in the other side wall 34. On that side, the rim is in contact with the ramp. The jaws are then closed to hold the disc in that position.

As illustrated in FIG. 8, the operator then bends his arm and wrist so that the disc is adjacent to his body. The arm is then swung in the direction of the arrow in that Figure until both the wrist and arm are straight as illustrated in FIG. 9. As the arm is swung the pressure on the jaws is eased and the centrifugal force acting on the disc will force the jaws to open and to cause the disc to fly out in the direction of the arrow. The swinging of the arm will also cause the disc to spin as it travels through the air.

It will be understood of course that modifications can be made in the preferred embodiments illustrated and described herein without departing from the scope and purview of the invention as defined in the appended claims.

I claim:

1. Pincers for throwing and catching a flying disc having a central portion and a rim which is disposed out of the plane of the central portion, said pincers comprising: lower and upper jaws which selectively close for engaging and open for disengaging said disc, said jaws being interconnected at one end and having at the opposite ends of each, a pad for gripping the central portion of said disc, said jaws further having inner walls which face one another, the inner wall of said lower jaw having a depression which opens upwardly toward the inner wall of said upper jaw, said depression being defined at one side by a ramp which extends to the pad formed on said lower jaw and at the other side by a wall which curves to a ridge, a notch being formed on the side of said ridge opposite said depression for receipt of the rim when the disc is engaged by the pincers.

2. Pincers for throwing and catching a flying disc having a central portion and a rim which is disposed out of the plane of the central portion, said pincers comprising: lower and upper jaws which selectively close for engaging and open for disengaging said disc, said jaws being interconnected at one end and having at the opposite ends of each, a pad for gripping the cental portion of said disc, each said jaw having a pair of side walls spaced apart from one another and interconnected along one longitudinally extending edge of each by a web, said side walls being defined along another longitudinally extending edge by an inner wall, the inner walls of one said jaw facing the like walls of the other said jaw, the inner wall of said lower jaw having a depression which opens upwardly toward the inner wall of said upper jaw, said depression being defined at one side by a ramp which extends to the pad formed on said lower jaw and at the other side by a wall which curves to a ridge, a notch being formed on the side of said ridge opposite said depression for receipt of the rim when the disc is engaged by the pincers.

3. The pincers as claimed in claim 1 wherein said depression curves upwardly and outwardly to said pad and smoothly upwardly and outwardly to said ridge.

4. The pincers as claimed in claim 1 further including means for guiding said rim into said notch.

5. The pincers as claimed in claim 1 further including means for guiding said rim into said notch, said guiding means being a strip of flexible material having ends which are attached to the inner walls of said jaws.

6. The pincers as claimed in claim 1 further including a first handle formed on the outer wall of said lower jaw for receipt of an operator's fingers and a second handle formed on the upper jaw for receipt of the operator's thumb.

7. The pincers as claimed in claim 1 wherein the inner wall of said lower jaw has a protuberance on the side of said notch opposite said first ridge and wherein the inner wall of said upper jaw has a ridge which faces said protuberance and which, when said pincers are closed, is spaced sufficiently close to said protuberance to prevent the disc from passing therethrough.

8. The pincers as claimed in claim 2 wherein said depression curves upwardly and outwardly to said pad and smoothly upwardly and outwardly to said ridge.

9. The pincers as claimed in claim 2 further including means for guiding said rim into said notch.

10. The pincers as claimed in claim 2 further including means for guiding said rim into said notch, said guiding means being a strip of flexible material having ends which are attached to the inner walls of said jaws.

11. The pincers as claimed in claim 2 further including a first handle formed on the outer wall of said lower jaw for receipt of an operator's fingers and a second handle formed on the upper jaw for receipt of the operator's jaw.

12. The pincers as claimed in claim 2 wherein the inner wall of said lower jaw has a protuberance on the side of said notch opposite said first ridge and wherein the inner wall of said upper jaw has a ridge which faces said protuberance and which, when said pincers are closed, is spaced sufficiently close to said protuberance to prevent the disc from passing therethrough.

* * * * *